United States Patent [19]

Beauregard et al.

[11] Patent Number: 4,616,393

[45] Date of Patent: Oct. 14, 1986

[54] APPARATUS AND METHOD FOR ROLLING A METAL MATRIX-COMPOSITE PLATE OR SHEET

[75] Inventors: Richard J. Beauregard, Forest; John B. Boyd, Lynchburg, both of Va.

[73] Assignee: The Babcock & Wilcox Company, New Orleans, La.

[21] Appl. No.: 697,555

[22] Filed: Feb. 1, 1985

[51] Int. Cl.[4] ..... B23P 17/00

[52] U.S. Cl. ..... 29/423; 29/424

[58] Field of Search ..... 72/199, 365, 366; 29/423, 424

[56] References Cited

U.S. PATENT DOCUMENTS

| | | | |
|---|---|---|---|
| 2,837,817 | 6/1958 | Kelley | 29/424 |
| 3,156,974 | 11/1964 | Bobrowsky | 29/424 |
| 4,478,662 | 10/1984 | Canellos | 29/424 |

*Primary Examiner*—Howard N. Goldberg
*Assistant Examiner*—Steven Nichols
*Attorney, Agent, or Firm*—Vytas R. Matas; Robert J. Edwards

[57] ABSTRACT

An apparatus and method for rolling metal matrix composite material is disclosed. The material is confined within an aperture in a frame member during the rolling process. The frame member has deformation properties compatible with that of the metal matrix composite material permitting the frame member to be deformed during the rolling process and allowing the surfaces defining the aperture in the frame member to constrain the material during this process, thus eliminating edge cracking of the material. The frame member may be interposed between a top member and a bottom member both having deformation properties compatible with that of the metal matrix composite material so as to "encapsulate" the material during the rolling process.

8 Claims, 2 Drawing Figures

APPARATUS AND METHOD FOR ROLLING A METAL MATRIX COMPOSITE PLATE OR SHEET

TECHNICAL FIELD

The present invention relates to an apparatus and method for rolling a metal matrix composite material, and more particularly to an apparatus and method which prevents cracking of the edges of such material during the rolling process.

BACKGROUND ART

Discontinuous fiber reinforced metal matrix composite materials exhibit increased stiffness and strength in comparison to the metal which forms basis thereof, and are formable using standard metal forming equipment. Some of the more popular metal matrix composite materials are various aluminum alloys reinforced with discontinuous fibers of silicon carbide. In the process of making sheet or plate product from metal matrix composite materials, the material is typically hot rolled in several passes from a starting billet, plate or extruded plank. Generally, the rolling mills which are used to roll the metal matrix composite material are those which are also used to roll normal alloys. It has been found that during the rolling process, the resulting rolled sheet or plate of metal matrix composite material is subject to edge cracking, and that such cracking can affect from 15 to 50 percent of the rolled width. The loss of 15 percent or more of the rolled width is a severe cost penalty for the use of a material which has such desirable strength and stiffness properties. Procedures which have been attempted to reduce such edge cracking include extruding the hot pressed billets and then rolling perpendicularly to the extrusion direction. Unfortunately, such procedures have not been too successful and producers and users of metal matrix composite materials have reluctantly accepted a loss of such material due to edge cracking during the rolling process.

Because of the foregoing, it has become desirable to develop an apparatus and a method for eliminating edge cracking of metal matrix composite material during the rolling process.

SUMMARY OF THE INVENTION

The present invention solves the aforementioned problems associated with the prior art and other problems by providing a frame having an aperture therein for the receipt of a metal matrix composite material so as to constrain same during the rolling process. The frame is interposed between and welded to a bottom plate and a top plate so that the metal matrix composite material is fully "encapsulated" therein. The frame, along with the bottom plate and the top plate, are all formed from a ductile material which deforms as the metal matrix composite material deforms during the rolling process. The frame provides edge restraint to the metal matrix composite material which prevents the edges of the material from cracking.

DESCRIPTION OF THE PREFERRED EMBODIMENT

Figure 1:
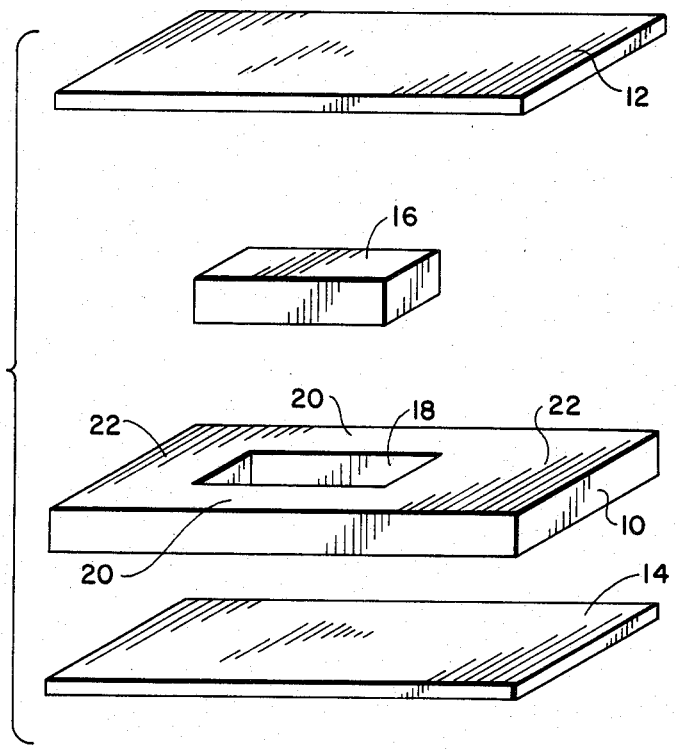
FIG. 1 is an exploded perspective view of the present invention.

Referring now to the drawings where the illustrations are for the purpose of describing the preferred embodiment of the present invention, and are not intended to limit the invention hereto, FIG. 1 illustrates the apparatus required for this new rolling method. This apparatus includes a frame 10, a top plate 12, a bottom plate 14, and a metal matrix composite core 16 whose thickness is to be reduced by the rolling process.

The frame 10 is metallic and is typically fabricated from 6061 aluminum or a similar ductile material which will deform as the metal matrix composite core 16 deforms. The thickness of the frame 10 is the same as the thickness of the metal matrix composite core 16 prior to rolling. An aperture 18 having dimensions slightly greater than the length and width of the metal matrix composite core 16, prior to rolling, is provided within the frame 10. The size of the frame 10 is such that the location of the aperture 18 therein permits the formation of edge rail areas 20 parallel to the direction of rolling and end rail areas 22 perpendicular to the direction of rolling. The resulting width of the edge rail areas 20 is sufficient to provide the necessary support for the metal matrix composite core 16 during the rolling process. The resulting width of the end rail areas 22 is sufficient to provide a weld free zone, and a heat effect free zone, during the welding process, hereinafter described.

The top plate 12 and the bottom plate 14 are metallic and are typically fabricated from 6061 aluminum or a similar ductile material which will deform as the metal matrix composite core 16 deforms. The length and width of the top plate 12 and the bottom plate 14 are the same as the length and width of the frame 10. The thickness of the top plate 12 and the bottom plate 14 is typically less than the thickness of the frame 10, however, the resulting thickness is determined by the physical properties of the metal matrix composite core 16 and the user's personal preferences. The harder the metal matrix composite core 16 relative to the hardness of the top plate 12 and the bottom plate 14, the thicker the top plate 12 and the bottom plate 14 will have to be. If the material comprising the top plate 12 and the bottom plate 14 is expected to bond to the metal matrix composite core 16 during the rolling process so as to form a laminated construction, the final required thickness of the laminant will dictate the initial thickness of the top 12 and the bottom plate 14. It should be noted that it may be preferable to start with a relatively thick top plate 12 and bottom plate 14 so as to maintain a final assembly thickness at the last rolling station that is greater than the minimum thickness the rolling station can handle with accuracy.

The metal matrix composite core 16 is a discontinuous fiber reinforced metal matrix composite material, such as an aluminum alloy reinforced with discontinuous fibers of silicon carbide to a volume of approximately 20 to 40 per cent. The core 16 can be in the form of a sheet, an extruded plank, or a hot pressed billet. The use of a hot pressed billet eliminates the need for previous rolling operations to the sheet or for the use of the extrusion process on the plank. Whatever approach is used, the resulting length and width of the core 16 is slightly less than the length and width of the aperture 18 within the frame 10, and the thickness of the core 16 is the same as that of the frame 10.

Figure 2:
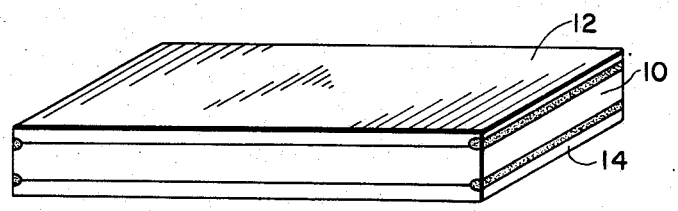
FIG. 2 is a perspective view of the present invention in an assembled condition.

In preparation for the rolling process, the frame 10 is placed on the bottom plate 14, and the core 16 is received within the aperture 18 in the frame 10. The top plate 12 is then placed on top of the frame 10, and the top plate 12 and the bottom plate 14 are welded to the frame 10 at both ends thereof, as shown in FIG. 2. If desired, the sides of the top plate 12 and the bottom plate 14 can also be welded to the frame 10. In any event, unless a vacuum is "pulled" on the completed assembly, gas vents should be provided by not closing the welds at the corners of the top plate 12 and the bottom plate 14.

Because of its ductile properties, the frame 10 deforms as much as the core 16 during the rolling process. The frame 10 provides edge restraint to the core 16 which prevents the edges of the core 16 from cracking. Thus, the core 16 can be "rolled" to the desired thickness without any loss of material due to edge cracking. After the rolling process has been completed, the core 16, which is now in the form of a metal matrix composite sheet, can be easily removed from the frame 10 by cutting inboard of the welds between the top plate 12, the bottom plate 14 and the frame 10. The removal process can be eased by coating the surfaces of the core 16 with a suitable stop-off compound, prior to rolling. The use of such a stop-off compound helps prevent diffusion bonding between the core 16 and the top plate 12, the bottom plate 14 and the frame 10. It should be noted that in some instances the use of a top plate 12 and/or a bottom plate 14 is not necessary. For example, if the rates of thermal expansion of the materials comprising the frame 10 and the core 16 are such that a press fit is maintained between the core 16 and the frame 10 at the rolling temperature, then the option of rolling the assembly without the use of a top plate 12 and a bottom plate 14 is available. However, the use of a top plate 12 and a bottom plate 14 does provide a significant advantage in that it places a ductile material, rather than the core, in direct contact with the rolling mills. This may significantly influence the acceptability of rolling metal matrix composite material at a large number of mills. In addition, control of the surface finish of the resulting metal matrix composite sheet is possible through the use of the top plate 12 and the bottom plate 14.

The foregoing apparatus and method of rolling were used to reduce the thickness of a one-half inch thick plate of 25 percent (volume) silicon carbide particulate reinforced aluminum 6061 alloy plate through hot rolling to a final thickness of one-fourth inch thick plate. The frame was fabricated from 6061-T6 aluminum alloy and had a thickness of one-half inch. The top plate and the bottom plate were similarly fabricated from 6061-T6 aluminum alloy, however, each of the plates was one-eighth inch thick. A stopoff material was applied to the silicon carbide/aluminum plate prior toencasement in the frame assembly. The top plate and the bottom plate were welded, along all four sides thereof, to the frame. The resulting assembly was rolled at 900° F. in two or three heavy passes and one light pass to a final thickness of one-fourth inch for the silicon carbide/aluminum plate. The resulting silicon carbide/aluminum plate exhibited no edge cracking. For comparison purposes, the same silicon carbide/aluminum material was rolled at the same temperature in the same mill to the same resulting thickness, and the resulting plate experienced extensive edge cracking resulting in the loss of about 15 percent of the material comprising the plate.

In addition to eliminating the costly waste of material due to edge cracking, this new apparatus and rolling method permit the rolling of a hot pressed billet directly into a plate without any intermediate production steps, such as extruding the billet into the desired configuration for rolling. Thus, the elimination of such intermediate production steps result in additional economies.

Certain modifications and improvements will occur to those skilled in the art upon reading the foregoing description. It will be understood that all such improvements and modifications have been deleted herein for the sake of conciseness and readability, but are properly within the scope of the following claims.

We claim:

1. Apparatus for constraining a metal matrix composite material during the rolling process comprising a frame member having an aperture formed therein with a configuration complementary to the configuration of the material to be rolled and being formed from a ductile material having deformation properties compatible with the deformation properties of the material to be rolled, said aperture receiving the material and constraining same during the rolling process.

2. The apparatus as defined in claim 1 wherein the thickness of said frame member is substantially equal to the thickness of the material to be rolled.

3. The apparatus as defined in claim 1 further including a top member and a bottom member, said frame member being interposed between and fastened to said top member and said bottom member.

4. The apparatus as defined in claim 1 wherein said top member and said bottom member are formed from ductile material having deformation properties compatible with the deformation properties of the material to be rolled.

5. A method for rolling a metal matrix composite material comprising the steps of:

placing the material in an aperture provided in a frame member, said frame member being formed from a ductile material having deformation properties compatible with the deformation properties of the material to be rolled; and rolling said frame member and the material received therein to a desired thickness.

6. The method as defined in claim 5 wherein the thickness of said frame member is substantially equal to the thickness of the material prior to rolling.

7. A method for rolling a metal matrix composite material comprising the steps of:

placing a frame member having an aperture thereon on a bottom member;

placing the material in said aperture in said frame member;

placing a top member on said frame member to form an assembly comprising said top member, bottom member and frame member in which the material is received, said frame member, and top member being formed from ductile material having deformation properties compatible with the deformation properties of the material to be rolled;

fastening said frame member to said top member and said bottom member; and rolling said assembly to a desired thickness for the material.

8. The method as defined in claim 7 wherein the thickness of said frame member is substantially equal to the thickness of the material prior to rolling.

* * * * *